US008926074B2

(12) United States Patent
Morino et al.

(10) Patent No.: US 8,926,074 B2
(45) Date of Patent: Jan. 6, 2015

(54) LIQUID CARTRIDGE AND IMAGE FORMING APPARATUS

(71) Applicants: Tetsu Morino, Osaka (JP); Tsunehiko Ishii, Tokyo (JP)

(72) Inventors: Tetsu Morino, Osaka (JP); Tsunehiko Ishii, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/727,846

(22) Filed: Dec. 27, 2012

(65) Prior Publication Data

US 2013/0176367 A1 Jul. 11, 2013

(30) Foreign Application Priority Data

Jan. 5, 2012 (JP) ..... 2012-000416

(51) Int. Cl.
*B41J 2/175* (2006.01)

(52) U.S. Cl.
CPC ..... *B41J 2/1752* (2013.01); *B41J 2/17513* (2013.01); *B41J 2/17523* (2013.01)
USPC ..... 347/86

(58) Field of Classification Search
USPC ..... 347/86
See application file for complete search history.

(56) References Cited

U.S. PATENT DOCUMENTS 5,619,237 A * 4/1997 Inoue et al. ..... 347/86
5,666,146 A * 9/1997 Mochizuki et al. ..... 347/86
6,817,707 B1 11/2004 Fowler et al.
2001/0040613 A1 11/2001 Nakazawa et al.
2002/0196317 A1 12/2002 Santhanam et al.
2003/0156171 A1* 8/2003 Yamaguchi et al. ..... 347/86
2003/0234844 A1 12/2003 Yamamoto et al.
2005/0157109 A1 7/2005 Muranaka et al.
2008/0049087 A1 2/2008 Morino
2009/0256892 A1 10/2009 Takeuchi
2009/0303299 A1 12/2009 Gilson et al.
2010/0026742 A1 2/2010 Morino
2011/0057997 A1 3/2011 Takeuchi
2012/0242762 A1 9/2012 Gilson et al.

FOREIGN PATENT DOCUMENTS

CN 101242957 8/2008
EP 0516088 A2 12/1992
EP 1114725 A2 7/2001

(Continued)

OTHER PUBLICATIONS

European Search Report dated Mar. 11, 2013 in corresponding European patent application No. 12 19 9171.5.

(Continued)

*Primary Examiner* — Stephen Meier
*Assistant Examiner* — Alexander D Shenderov
(74) *Attorney, Agent, or Firm* — Cooper & Dunham LLP

(57) ABSTRACT

Disclosed is a liquid cartridge containing a liquid supplied to a recording head to eject liquid drops. The liquid cartridge includes a case member, and a liquid container member disposed inside the case member. The case member includes a base member, and a cover member having a snap-fit part and configured to be fit in the base member, the cover member and the base member being snap-fit connected via the snap-fit part. The base member includes a hole part via which a snap-fit connected state of the snap-fit part of the cover member is viewable from outside in a condition where the cover member and the base member are snap-fit connected by sliding the cover member and the base member.

6 Claims, 26 Drawing Sheets

(56) References Cited

FOREIGN PATENT DOCUMENTS

| | | | |
|---|---|---|---|
| EP | 1331096 | A2 | 7/2003 |
| EP | 2110252 | A2 | 10/2009 |
| EP | 2292431 | A1 | 3/2011 |
| JP | 2001-121358 | | 5/2001 |
| JP | 2001-347687 | | 12/2001 |
| JP | 2003-237098 | | 8/2003 |
| JP | 2005-14437 | | 1/2005 |
| JP | 2005-155845 | | 6/2005 |
| JP | 2005-215449 | | 8/2005 |

OTHER PUBLICATIONS

Chinese official action dated Jul. 2, 2014 and English translation in corresponding Chinese patent application No. 2013 10 00 2570.X.

* cited by examiner

LIQUID CARTRIDGE AND IMAGE FORMING APPARATUS

BACKGROUND OF THE INVENTION

1. Field of the Invention

The disclosures discussed herein relate to a liquid cartridge, and an image forming apparatus.

2. Description of the Related Art

An inkjet recording apparatus is generally known as an example of a liquid-jet recording type image forming apparatus having a recording head formed of a liquid-jet head (liquid-drop jet head), such as a printer, a facsimile machine, or a plotter, or a combination of these functions.

Japanese Laid-open Patent Publication No. 2005-014437 (hereinafter referred to as "Patent Document 1"), for example, discloses a liquid cartridge for use in such an image forming apparatus.

Similarly, Japanese Laid-open Patent Publication No. 2001-347687 (hereinafter referred to as "Patent Document 2"), for example, discloses a liquid cartridge for use in such an image forming apparatus. The liquid cartridge includes a snap-fit part formed between a side surface of the first ink cartridge and a side surface of the second ink cartridge; and an inlet part having respective inlet holes into which a projection formed on the front end of the first cartridge and a projection formed on the second cartridge are inserted.

RELATED ART DOCUMENT

Patent Document

Patent Document 1: Japanese Laid-open Patent Publication No. 2005-014437

Patent Document 2: Japanese Laid-open Patent Publication No. 2001-347687

However, with the configuration disclosed in patent Document 1, since the cartridge cases need to be screwed, assembling of parts may be burdensome, and hence, it may be difficult to automate such assembling operations. Similarly, with the configuration disclosed in patent Document 2, it may be difficult to automate assembling the liquid cartridge itself.

SUMMARY OF THE INVENTION

It is a general object of at least one embodiment of the present invention to provide a liquid-jet head and a liquid-jet device capable of suppressing liquid discharge malfunction caused by filters between each of pressurized liquid chambers and a common liquid chamber, which substantially eliminate one or more problems caused by the limitations and disadvantages of the related art.

Accordingly, it is a general object of at least one embodiment of the present invention to provide a liquid cartridge and an image forming apparatus in which the liquid cartridge is capable of being automatically assembled to improve workability of assembling the liquid cartridge, which substantially eliminate one or more problems caused by the limitations and disadvantages of the related art.

According to an embodiment, there is provided a liquid cartridge containing a liquid supplied to a recording head to eject liquid drops. The liquid cartridge includes a case member; and a liquid container member disposed inside the case member. The case member includes: a base member; and a cover member having a snap-fit part and configured to be fit in the base member, the cover member and the base member being snap-fit connected via the snap-fit part. The base member includes a hole part via which a snap-fit connected state of the snap-fit part of the cover member is viewable from outside in a condition where the cover member and the base member are snap-fit connected by sliding the cover member and the base member.

Additional objects and advantages of the embodiments will be set forth in part in the description which follows, and in part will be obvious from the description, or may be learned by practice of the invention.

It is to be understood that both the foregoing general description and the following detailed description are exemplary and explanatory only and are not restrictive of the invention, as claimed.

BRIEF DESCRIPTION OF THE DRAWINGS

Other objects and further features of embodiments will be apparent from the following detailed description when read in conjunction with the accompanying drawings, in which:

FIGS. 13A and 13B are enlarged views illustrating movements of a snap-fit part of the case cover;

DESCRIPTION OF THE PREFERRED EMBODIMENTS

A detailed description is given of an ink-jet recording device serving as an image forming apparatus to which preferred embodiments are applied with reference to the accompanying drawings.

Figure 1:
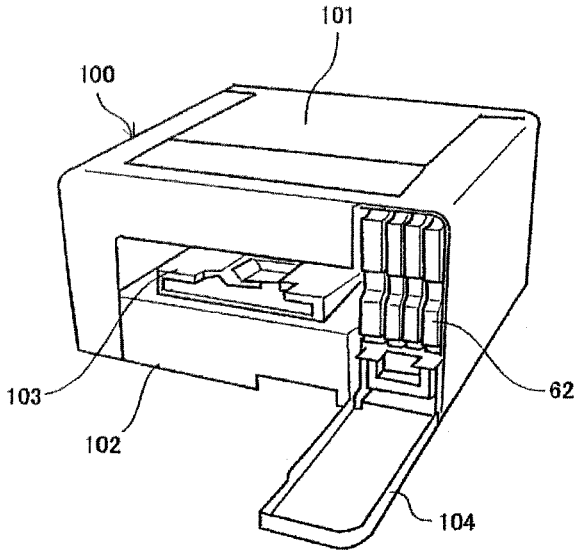
FIG. 1 is an external perspective view illustrating an example of an image forming apparatus according to an embodiment.

In the following, preferred embodiments of the present invention will be described with reference to the accompanying drawings. First, an example of an image forming apparatus according to an embodiment is described with reference to FIGS. 1 to 4. Note that FIG. 1 is an external perspective view illustrating an example of the image forming apparatus according to the embodiment, FIG. 2 is a perspective view illustrating a mechanical part of the image forming apparatus, FIG. 3 is a plan view illustrating a main part of the mechanical part, and FIG. 4 is a side view illustrating a carriage part of the mechanical part.

The image forming apparatus is a serial-type image forming apparatus that includes an apparatus main body 100, an openable and closable cover 101 attached to the apparatus main body 100 such that the cover 101 is open or closed in a direction toward a top surface of the apparatus main body 100. A mechanical part residing inside the apparatus main body 100 may be accessible by opening the cover 101. Further, a front surface of the apparatus main body 100 includes a paper-feeding tray 102 and a paper-receiving tray 103.

Further, a front surface on the right of the apparatus main body 100 includes an openable and closable cover 104, such that an ink cartridge serving as a liquid cartridge according to the embodiment may be attached to or removed from a cartridge holder 61 of the apparatus main body 100 by opening the cover 104.

Figure 2:
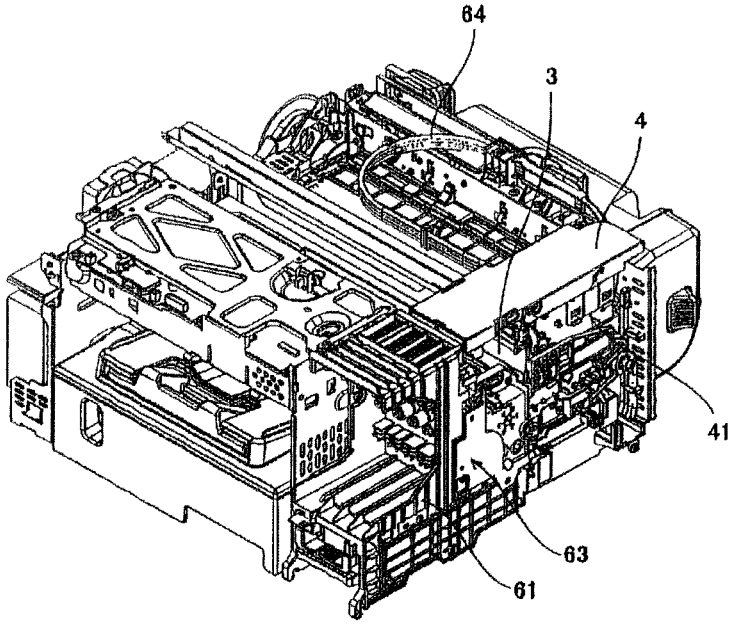
FIG. 2 is a perspective view illustrating a mechanical part of the image forming apparatus according to the embodiment.
Figure 3:
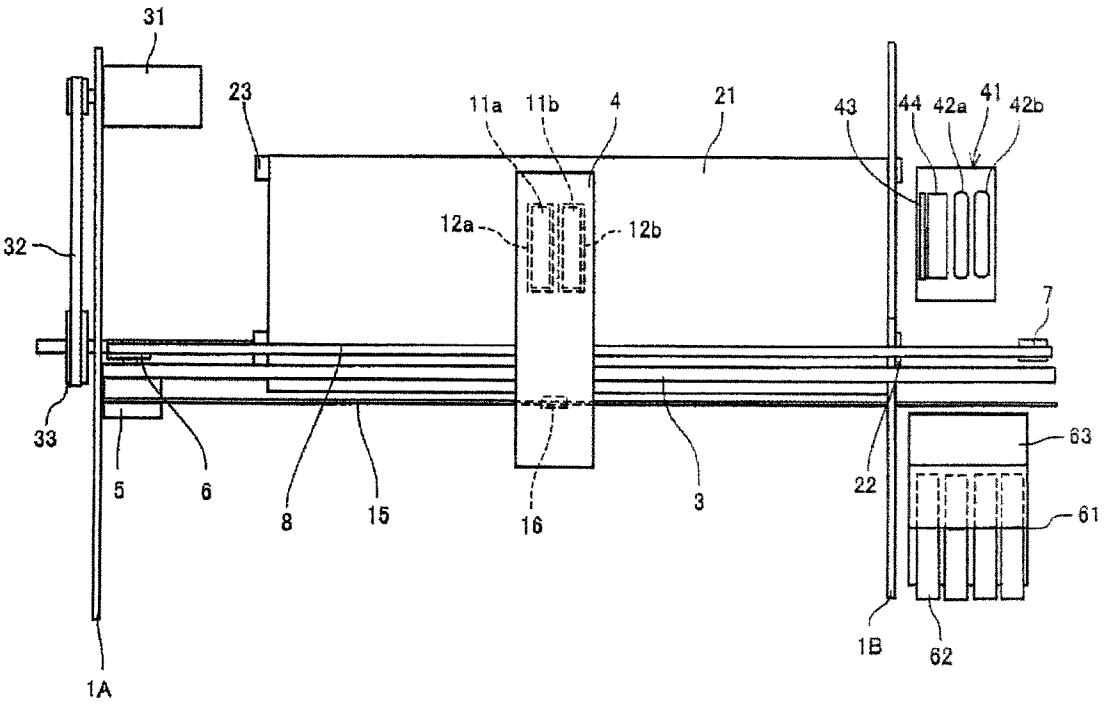
FIG. 3 is a plan view illustrating a main part of the mechanical part.
Figure 4:
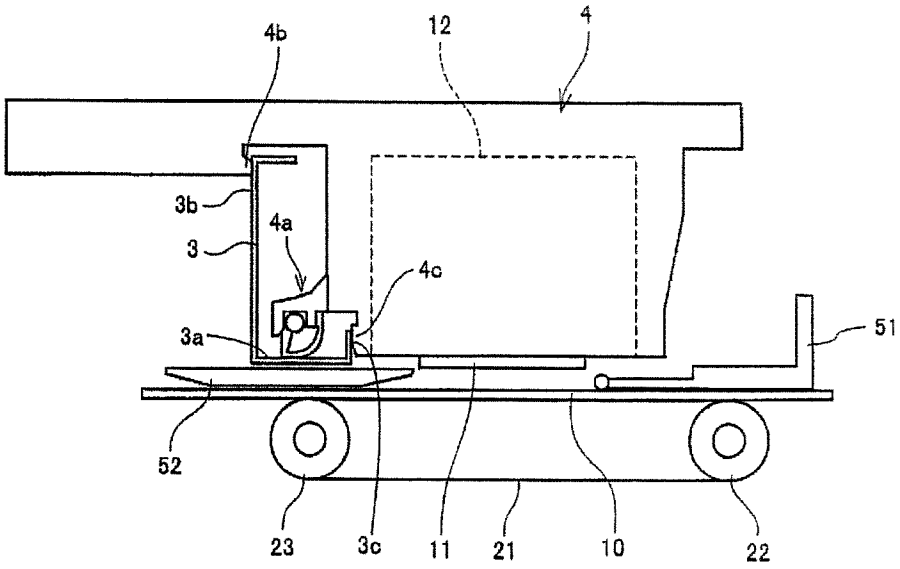
FIG. 4 is a side view illustrating a carriage part of the mechanical part.

As illustrated in FIGS. 2 and 3, the mechanical part is configured to movably support a carriage 4 in a main-scanning direction with a guide member 3 formed of a plate member serving as a guide member bridged between a left side plate 1A and a right side plate 1B. Specifically, the mechanical part is configured to move the carriage 4 to scan in the main-scanning direction by causing a main scanning motor 5 to drive a timing belt 8 tightly looped over a driving pulley 6 and a driven pulley 7.

Note that as illustrated in FIG. 4, the guide member 3 configured to guide traveling of the carriage 4 is formed of a plate member, and includes a guide surface 3*a* serving as a support surface for movably guiding the carriage 4, and guide surfaces 3*b* and 3*c*.

The carriage 4 is configured to serve as a rodless type guide mechanism that includes a height adjusting part 4*a* movably supported on the guide surface 3*a* of the guide member 3, a contact part 4*b* movably contacting the guide surface 3*b*, and a contact part 4*c* movably contacting the guide surface 3*c*.

The carriage 4 includes recording heads 11*a* and 11*b* (also collectively referred to as a "recording head 11") composed of liquid-jet heads serving as image forming units configured to eject liquid drops of yellow (Y), cyan (C), magenta (M), and black (K). In the carriage 4, the liquid-jet heads include nozzle arrays having nozzles disposed in a sub-scanning direction orthogonal to the main-scanning direction with liquid drop ejecting directions of the nozzles being downward.

Each of the recording heads 11 includes two nozzle arrays, such that a total of four nozzle arrays are configured to eject liquid drops of four colors Yellow (Y), Magenta (M), Cyan (C), and Black (K), respectively.

The recording heads 11*a* and 11*b* integrally include head tanks 12*a* and 12*b*, respectively. The cartridge holder 61 of the apparatus main body 100 removably includes replaceable liquid cartridges (i.e., main tanks, hereinafter referred to as "ink cartridges") 62. Ink (liquid) is supplied to the head tanks 12*a* and 12*b* from the ink cartridges 62 by a transport pump unit 63 via respective tubes.

Further, an encoder scale 15 (scale: a position identifier) is disposed along the main-scanning direction of the carriage 4, and an encoder sensor 16 is disposed on the carriage 4 side. The encoder sensor 16 is composed of a transmission type photosensor configured to scan calibration of the encoder scale 15. The encoder scale 15 and the encoder sensor 16 form a linear encoder.

Meanwhile, a transfer belt 21 is disposed on a lower side of the carriage 4. The transfer belt 21 serves as a transfer unit configured to transfer a sheet 10 in the sub-scanning direction. The transfer belt 21 is formed of an endless belt that is looped over a transfer roller 22 and a tension roller 23. The transfer belt 21 is configured to rotationally travel in the sub-scanning direction by allowing the transfer roller 22 to be rotationally driven by a sub-scanning motor 31 via a timing belt 32 and a timing pulley 33.

As illustrated in FIG. 4, sheet guide members 51 and 52 are disposed at an entrance part and an exit part of the transfer belt, respectively.

A maintenance-restoration mechanism (a maintenance unit) 41 configured to maintain or restore the recording heads 11 is disposed on a lateral side of the transfer belt 21, which is on one side of the carriage 4 in the main-scanning direction. The maintenance-restoration mechanism 41 may include a suction cap 42*a* configured to cap a nozzle surface (where nozzles are formed) of the recording head 11 and a moisturizing cap 42*b*, a wiper member 43 configured to wipe the nozzle surface, a non-image forming liquid receiver 44 configured to receive non-image forming liquid that is not used for image formation. The suction cap 42*a* is connected to a not-illustrated suction pump serving as a suction unit.

In the image forming apparatus having such a configuration, the transfer belt 21 intermittently transfers a sheet of paper being fed, and the recording head 11 is driven according to image signals while the carriage 4 is being moved in the main-scanning direction. Accordingly, liquid drops are ejected on the sheet to record a line of an image while the sheet is unmoved, and then an operation of recording subsequent lines of the image is performed line-by-line (repeated) after the sheet is moved in a predetermined amount every time a line has been recorded. After having formed the entire image on the sheet, the sheet is discharged from the apparatus main body of the image forming apparatus.

In maintaining or restoring nozzles of the recording head 11, the carriage 4 is moved to a home position that faces the maintenance-restoration mechanism 41, where a restoration operation is performed such as a nozzle suction operation including suctioning the nozzles after attaching the suction cap 42 on the nozzle surface, or discharging a non-image forming liquid unused for forming an image from the nozzles into the suction cap 42*a* or the non-image forming liquid receiver 44. Accordingly, the image may be formed on the sheet by stably discharging the liquid drops.

Figure 5:
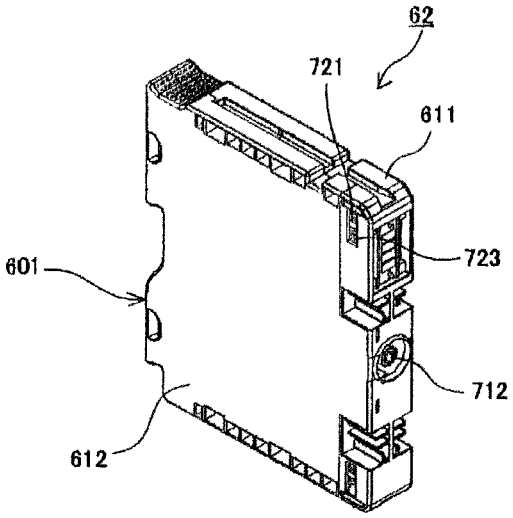
FIG. 5 is an external perspective view illustrating an ink cartridge.
Figure 6:
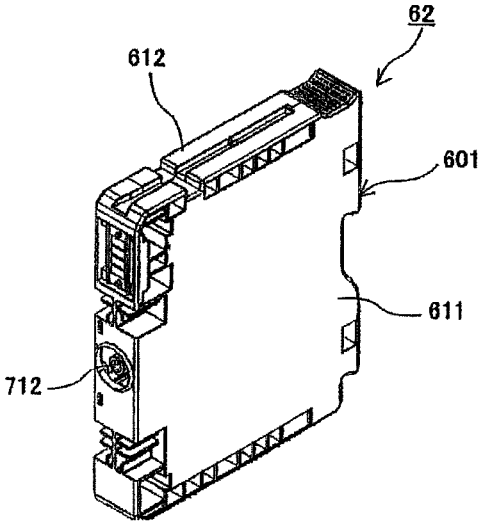
FIG. 6 is an external perspective view illustrating the ink cartridge viewed from a side opposite from the illustration of FIG. 5.
Figure 7:
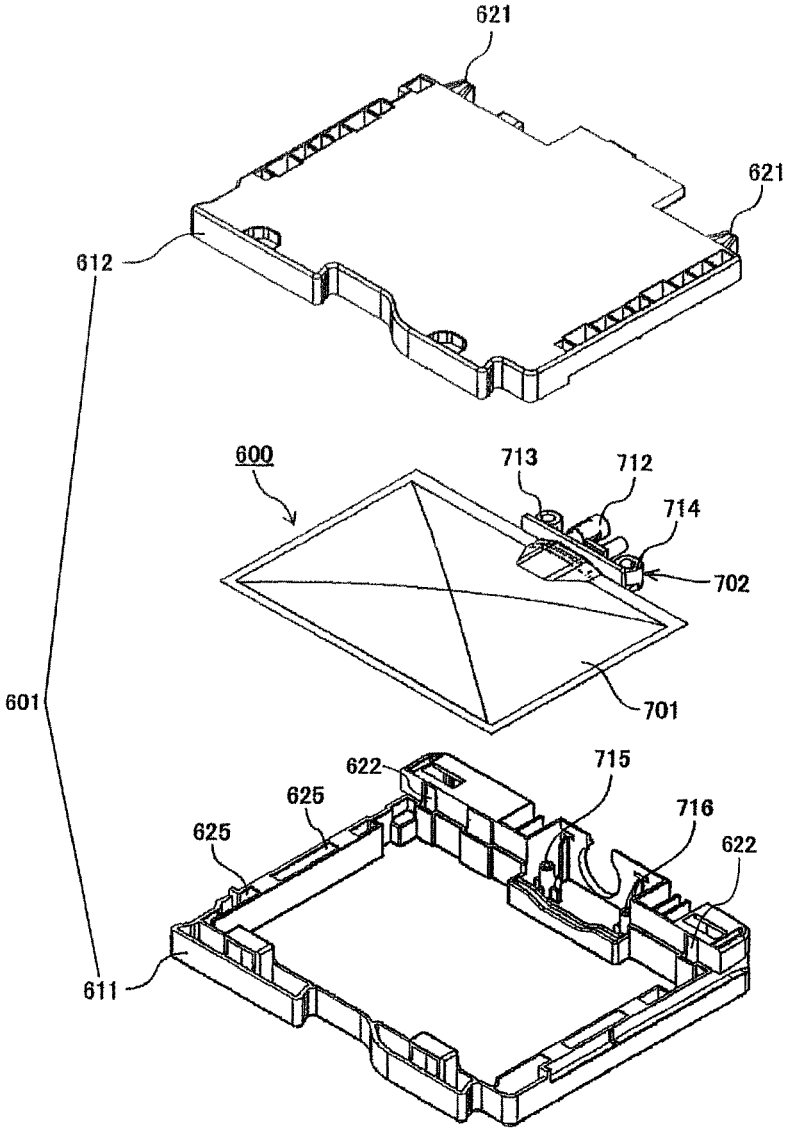
FIG. 7 is an exploded perspective view illustrating the ink cartridge.

Next, details of the ink cartridge 62 are described with reference to FIGS. 5 to 7. FIGS. 5 and 6 are external perspective views illustrating the ink cartridge 62 viewed from different directions, and FIG. 7 is an exploded perspective view illustrating the ink cartridge 62.

The ink cartridge 62 includes an ink bag 600 formed of a liquid container member configured to contain liquid ink to be supplied to the head tank 12 of the recording head 11, and a cartridge case 601 formed of a case member internally containing the ink bag 600.

The cartridge case 601 includes a case base 611 formed of a base member, and a case cover 612 formed of a cover member into which the case base 611 is fit. The case base 611 and the case cover 612 are connected in a snap-fit fashion.

That is, the case cover 612 includes a snap-fit part 621, and the case base 611 includes a snap-fit part inserting part 622 into which the snap-fit part 621 of the case cover 612 is inserted.

Note that, the case base 611 further includes a hole part 623 (see FIGS. 9A and 9B) via which the snap-fit part 621 of the case cover 612 is externally viewable when the snap-fit part 621 of the case cover 612 is inserted into the snap-fit part inserting part 622 of the case base 611.

Figure 8A:
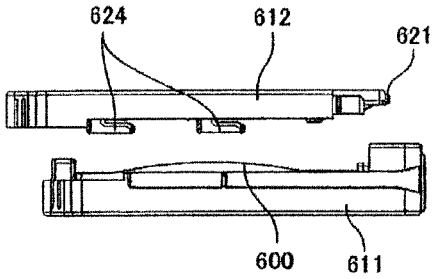
FIGS. 8A, 8B, and 8C are side views illustrating a method for assembling the ink cartridge.
Figure 8B:
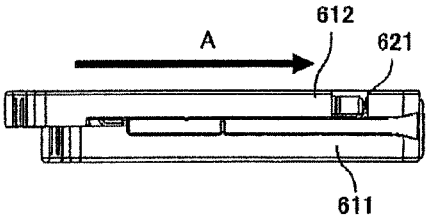
Figure 8C:
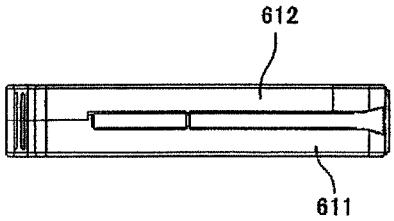

Next, a method for assembling the ink cartridge 62 is described with reference to FIGS. 8A to 10. FIGS. 8A, 8B, and 8C are side views illustrating the method for assembling the ink cartridge, FIGS. 9A and 9B are plan views illustrating the method for assembling the ink cartridge, and FIG. 10 is a perspective view illustrating the method for assembling the ink cartridge.

Figure 9A:
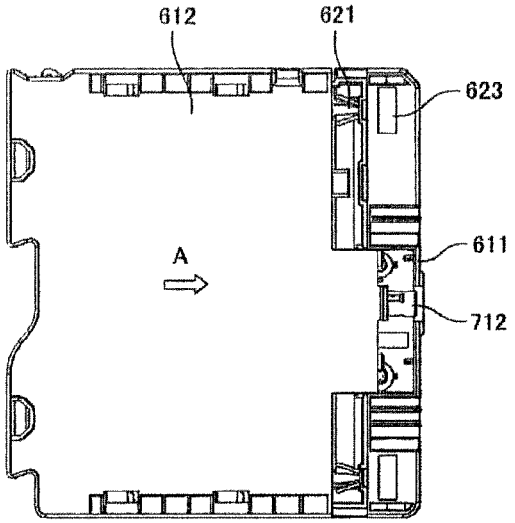
FIGS. 9A and 9B are plan views illustrating the method for assembling the ink cartridge.
Figure 10:
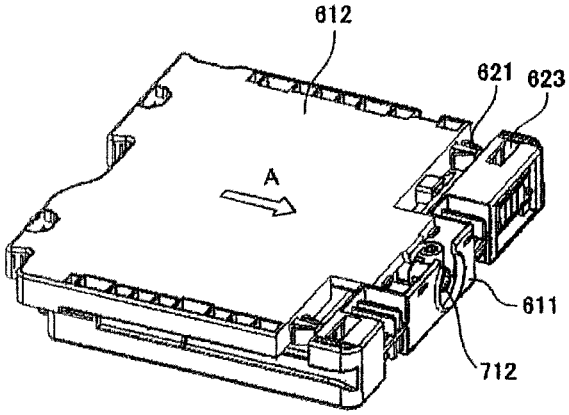
FIG. 10 is a perspective view illustrating the method for assembling the ink cartridge.

As illustrated in FIGS. 8A, 9A, and 10, hooks 624 of the case cover 612 are fit into respective hook receiving parts 625 (see FIG. 7) by shifting an inserting direction of the case cover 612 relative to the case base 611 containing the ink bag 600.

As illustrated in FIGS. 8B, 9A, and 10, the case cover 612 is slidably moved in an arrow A direction (i.e., the inserting direction).

Figure 9B:
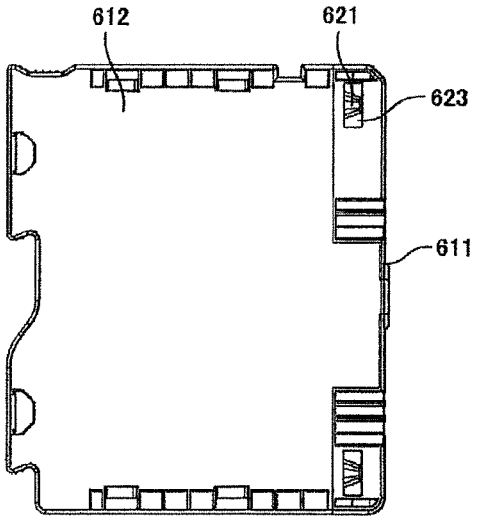

Accordingly, the snap-fit parts 621 of the case cover 612 are inserted into the respective snap-fit part inserting parts 622 of the case base 611 such that the case cover 612 and the case base 611 are connected in a snap-fit fashion as illustrated in FIGS. 8C and 9B.

In this situation, since the case base 611 includes the hole part 623, it may be possible to observe or view the snap-fit parts 621 of the case cover 612 from outside the cartridge case 601, when the snap-fit parts 621 are inserted into the snap-fit part inserting parts 622 or after the snap-fit parts 621 have been inserted into the snap-fit part inserting parts 622.

Accordingly, a connection status of the snap-fit part 621 of the case cover 612 and the snap-fit part inserting part 622 of the case base 611 may be observed, which may facilitate securely verifying whether the snap-fit connection has been completed.

Further, in a status of the snap-fit connection, the snap-fit parts 621 of the case cover 612 are configured such that the snap-fit parts 621 will not project from a surface of the case base 611.

In this configuration, it may be possible to prevent the ink cartridge 62 from interfering with the snap-fit part 621 or being caught on the snap-fit parts 621 when handling the ink cartridge 62 or inserting the ink cartridge 62 into the cartridge holder 61.

As described above, the ink cartridge 62 may be assembled by sliding the case cover 612 onto the case base 611 to establish a snap-fit connection. Hence, the assembling task may be facilitated. Further, since the case cover 612 is connected to the case base 611 by sliding the case cover 612 onto the case base 611, automatic assembly may be easily implemented.

Figure 11:
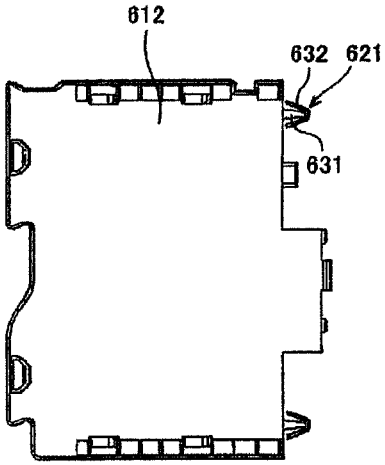
FIG. 11 is a plan view illustrating a snap-fit connection part of a case base and a case cover.

Next, details of the snap-fit connecting part of the case base 611 and the case cover 612 are described with reference to FIGS. 11 to 15. FIG. 11 is a plan view illustrating the snap-fit connection part of the case base 611 and the case cover 612, FIG. 12 is an enlarged perspective view illustrating the snap-fit connection part, FIGS. 13A and 13B are enlarged views illustrating movements of the snap-fit part 621 of the case cover 612, FIG. 14 is an enlarged plan view illustrating the snap-fit part 621 of the case cover 612, and FIG. 15 is an enlarged view illustrating a regulating part of the snap-fit part 621 of the case base 612.

Figure 14:
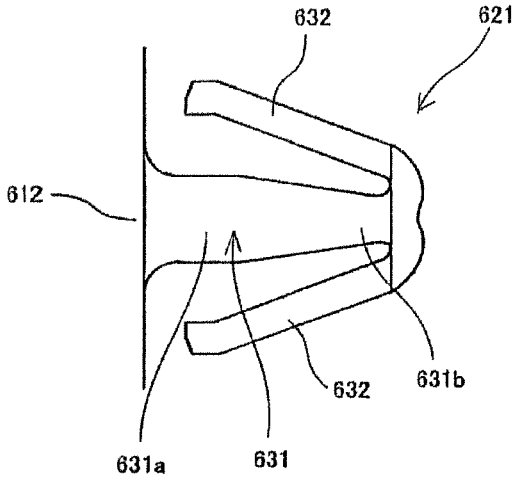
FIG. 14 is an enlarged plan view illustrating the snap-fit part of the case cover.
Figure 15:
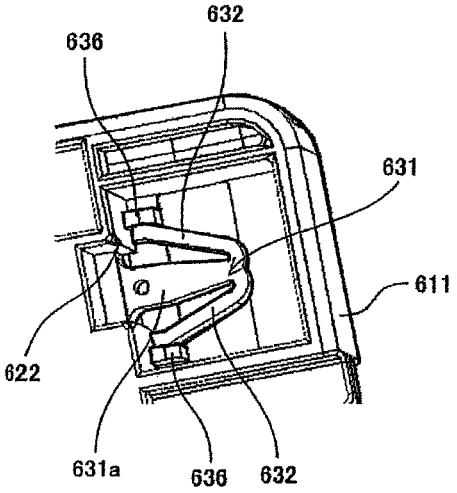
FIG. 15 is an enlarged view illustrating a regulating part of the snap-fit part of the case base.

The snap-fit part 621 of the case cover 612 includes, as illustrated in the enlarged view of FIG. 14, an arrow shape having two blade parts 632 folded back from two sides of a top end of a shaft 631 extending toward the inserting direction (the arrow A direction, see FIG. 10) of the case base 611.

Figure 12:
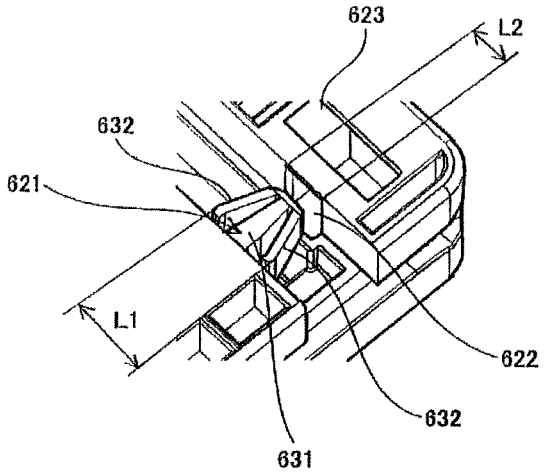
FIG. 12 is an enlarged perspective view illustrating the snap-fit connection part.

The blade parts 632 of the snap-fit part 621 are formed, as illustrated in FIG. 12, such that a width L1 of the blade parts 632 without restriction is formed greater than a width L2 of the snap-fit part inserting part 622 of the case base 611.

Figure 13A:
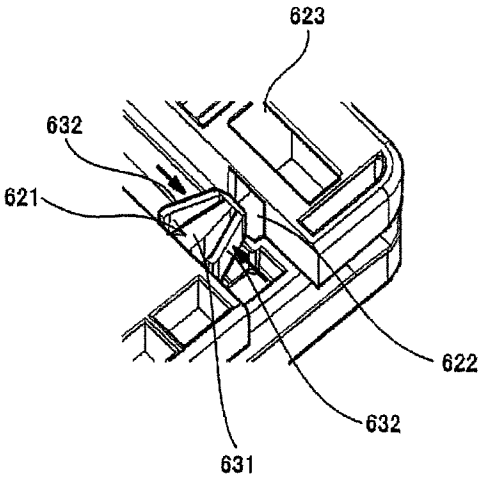

Accordingly, the snap-fit part 621 of the case cover 612 is inserted into the snap-fit part inserting part 622 of the case base 611 while the blade parts 632 of the snap-fit part 621 are pushed inward by forced contact with two lateral sides of the snap-fit part inserting part 622 as illustrated in FIG. 13A. Then, as illustrated in FIG. 13B, when the blade parts 632 of the snap-fit part 621 are completely inserted into the snap-fit part inserting part 622, the blade parts 632 are expanded outward by spring restoring forces and return to respective original positions, thereby completing the snap-fit connection.

Note that as illustrated in FIG. 14, the shaft 631 of the snap-fit part 621 includes a stem side 631*a* formed thicker than a top end side 631*b* serving as a fixing end side of the two blade parts 632.

In this configuration, when the snap-fit part 621 is inserted into the snap-fit part inserting part 622, deformation of the blade parts 632 toward the shaft 631 side is regulated by allowing the blade parts 632 to be attached to the stem side 631*a* of the shaft 631, which may prevent damage to the blade parts 632 caused by excessive pushing force imposed on the blade parts 632.

Further, as illustrated in FIG. 15, the case base 611 further includes ribs 636 configured to regulate the expansion of the respective blade parts 632 of the snap-fit part 621 when the expansion of the blade parts 632 exceeds a predetermined expanding amount 621 while the blade parts 632 are being inserted into the snap-fit part 621.

Accordingly, when force is applied to the case cover 612 in a direction of removing the case base 611 from the case cover 612, damage due to the expansion of the blade parts 632 of the snap-fit part 621 may be prevented while the blade parts 632 are prevented from being removed (come off) from the snap-fit part inserting part 622.

Figure 16:
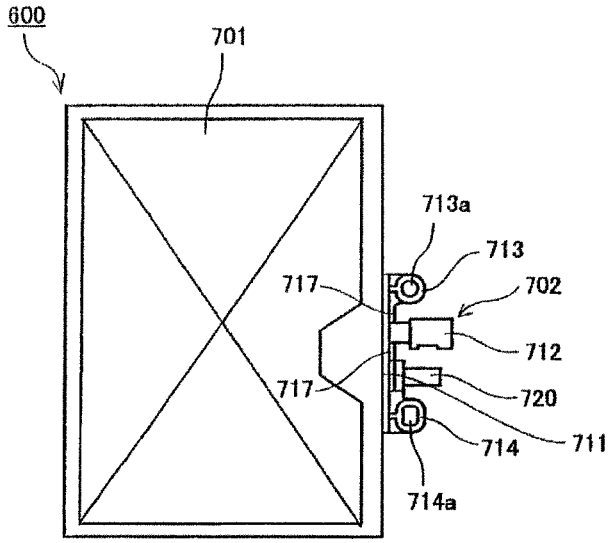
FIG. 16 is a side view illustrating an ink bag.
Figure 17:
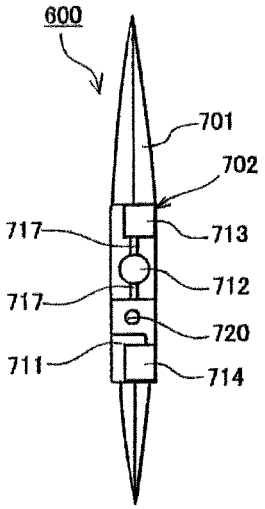
FIG. 17 is a front view illustrating the ink bag.
Figure 18:
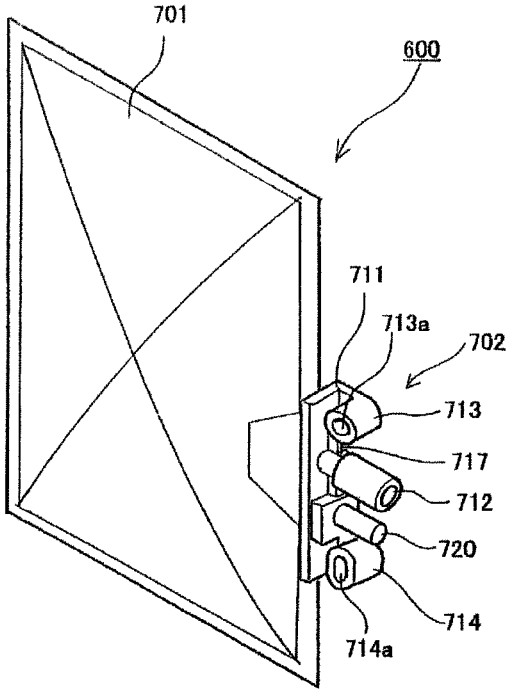
FIG. 18 is a perspective view illustrating the ink bag.
Figure 19:
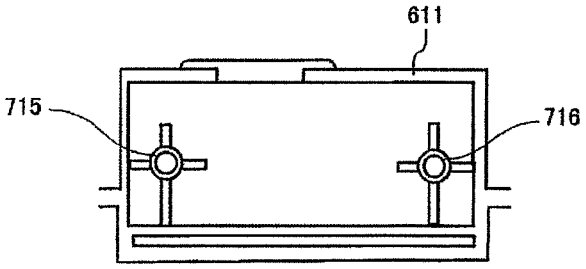
FIG. 19 is a plan view illustrating a main part of a base cover to which the ink bag is attached.

Next, the ink bag 600 serving as a liquid container bag according to the embodiment is described with reference to FIGS. 16 to 19. FIG. 16 is a side view illustrating the ink bag 600, FIG. 17 is a front view illustrating the ink bag 600, FIG. 18 is a perspective view illustrating the ink bag 600, and FIG. 19 is a plan view illustrating a main part of the base cover 611 to which the ink bag 600 is attached.

The ink bag 600 includes a bag main body 701 having an approximately rectangular shape, and an ink output member 702 disposed in the bag main body 701.

The ink output member 702 includes an ink supply port 712 configured to externally output ink contained in the bag main body 701, and the ink supply port 712 is disposed in an approximately central part (in an ink bag edge direction) of a planer main body part 711. The main body part 711 includes an ink filling port 720 disposed adjacent to the ink supply port 712. The ink filling port 720 is configured to fill the bag main body 701 with ink.

The main body part 711 further includes projected hole parts 713 and 714 for forming respective holes 713*a* and 714*a* on two sides sandwiching the ink supply port 712 in a direction intersecting the ink supply direction (i.e., the ink bag edge direction).

On the other hand, as illustrated in FIGS. 19 and 7, the case base 611 includes respective pin members 715 and 716 configured to fit in the holes 713*a* and 714*a* formed in the hole parts 713 and 714 of the ink output member 702 of the ink bag 600.

Figure 20:
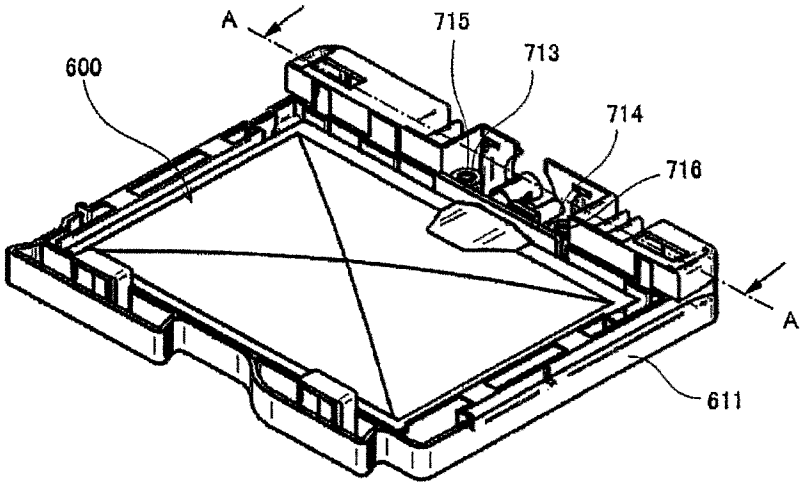
FIG. 20 is a perspective view illustrating a state of the case base to which the ink bag is attached.
Figure 21:
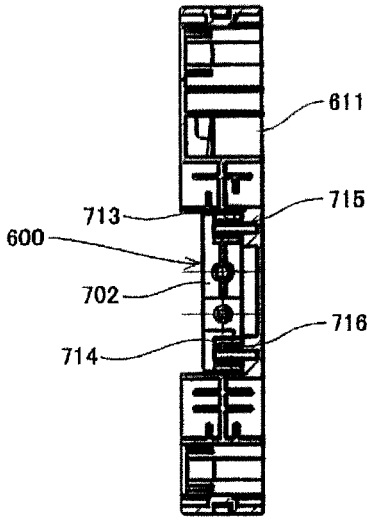
FIG. 21 is a cross-sectional view illustrating the case base of FIG. 20 taken along an A-A line.

With this configuration, as illustrated in FIGS. 20 and 21, when ink bag 600 is housed in the cartridge case 601, the pin members 715 and 716 are fit in the holes 713*a* and 714*a* of the hole parts 713 and 714 of the ink output member 702 of the ink bag 600 such that the ink bag 600 is attached to the case base 611.

Figure 22:
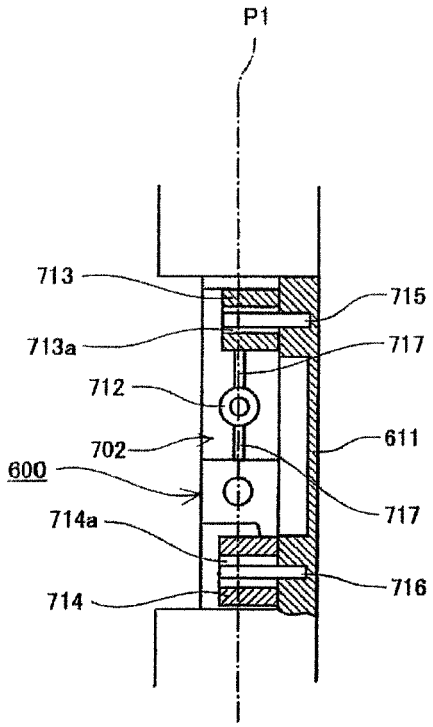
FIG. 22 is an enlarged view illustrating a main part of FIG. 21.

Note that as illustrated in FIG. 22, in a state of the ink bag 600 being attached to the case base 611, the pin members 715 and 716 of the case base 611 are extendedly formed or elongated such that the pin members 715 and 716 exceed a position P1 of the central axis of the ink supply port 712 of the ink bag 600 in a direction of fitting the ink bag 600 into the case base 611.

Likewise, the hole parts 713 and 714 of the ink output member 702 of the ink bag 600 are extendedly formed or elongated from the case base 611 side such that the hole parts 713 and 714 exceed the position P1 of the central axis of the ink supply port 712. In the above case, it is preferable that the hole parts 713 and 714 be extendedly formed longer than the position of the ink supply port 712.

The ink bag 600 may be stably retained by the case base 611 by having a relationship between lengths of the hole parts 713 and 714 and lengths of the pin members 715 and 716.

Accordingly, in the ink cartridge 62 according to the embodiment, the ink bag 600 may be easily located corresponding to the case base 611 to be attached to the case base 611, and further, damaging of the ink bag 600 may be prevented.

Further, the ink output member 702 of the ink bag 600 according to the embodiment includes reinforcing ribs 717 integrally formed with the main body part 711 between the ink supply port 712 and the hole part 713, and between the ink supply port 712 and the hole part 714. Note that the ink filling port 720 is located between the ink supply port 712 and the hole part 714.

Thus, the ink supply port 712 of the ink bag 600 may receive force when the ink cartridge 62 is inserted into (attached to) or extracted from (detached from) the cartridge holder 61. However, deformation or sloping of the ink output member 702 due to bending may be prevented by reinforcing the two hole parts 713 and 714 serving as supporting points.

Note that the hole 713*a* of the hole part 713 has a circular hole whereas the hole 714*a* of the hole part 714 has an elongated hole. In such a case, when the ink cartridge 62 is placed in an orientation such that the ink cartridge 62 is ready to be attached to the cartridge holder 61 (in an orientation of the ink cartridge 62 illustrated in FIG. 6), the upper side hole part 713 is configured to have a circular hole, and the lower side hole part 714 is configured to have an elongated hole.

That is, as mentioned earlier, the ink supply port 712 of the ink bag 600 is to receive force when the ink cartridge 62 is inserted into (attached to) or extracted from (detached from) the cartridge holder 61. However, it is preferable to have backlash in the direction of inserting or extracting the ink cartridge 62.

In this case, when the tolerance of hole diameters of the hole parts 713 and 714 of the ink output member 702, and the tolerance of components of the pin members 715 and 716 of the case base 611 are restricted (i.e., have little allowance), the pins may be forcibly inserted into the holes, which may undesirably result in receiving repulsive force.

Accordingly, the fitting of the pins into the holes may be facilitated by forming the hole 713*a* of the hole part 713 as a circular hole, and the hole 714*a* of the hole part 714 as an elongated hole, which may result in receiving no repulsive force.

In this case, when the ink cartridge 62 is placed in an orientation such that the ink cartridge 62 is ready to be attached to the cartridge holder 61, the upper side hole part 713 is configured to have a circular hole, and the lower side hole part 714 is configured to have an elongated hole in order to reduce backlash on a side receiving force (repulsive force against gravity or inserting force).

With such a configuration, the repulsive force due to fitting of the pins into the holes may be suppressed.

Further, the hole parts 713 and 714 of the ink output member 702 are provided in the positions more toward the front side than that of the bag main body 701 in an inserting direction of the ink cartridge 62.

That is, if, by contrast, the hole parts 713 and 714 of the ink output member 702 are provided in the positions more toward the rear side than the bag main body 701 in the inserting direction of the ink cartridge 62, the shape of the bag main body 701 is restricted. Accordingly, the amount of ink (liquid amount) containable in the bag main body 701 may be reduced. Thus, the containable ink (liquid) amount is not reduced by disposing the hole parts 713 and 714 of the ink output member 702 in the positions more toward the front side than that of the bag main body 701 in the inserting direction of the ink cartridge 62.

Figure 23:
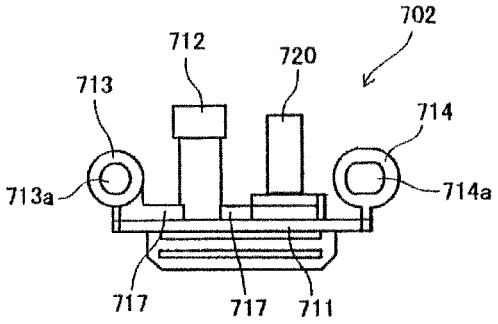
FIG. 23 is a plan view of an ink output member of an ink bag for illustrating another example of a pin member configuration on a case base side.
Figure 24:
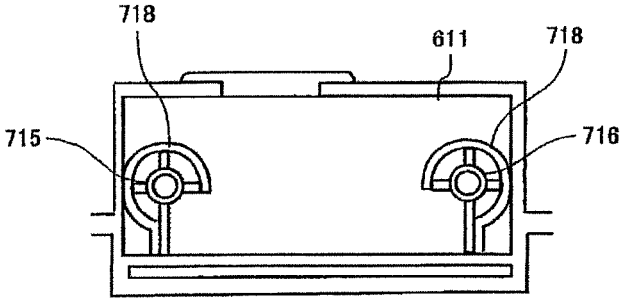
FIG. 24 is a plan view illustrating the pin member configuration on the case base side.

Next, another example of a pin member configuration on the case base 611 side is described with reference to FIGS. 23 and 24. Note that FIG. 23 is a plan view of the ink output member 702 of the ink bag 600 for illustrating another example of the pin member configuration on the case base 611 side, and FIG. 24 is a plan view illustrating the pin member configuration on the case base 611 side.

In this configuration, ribs 718 are raised around the pin members 715 and 716 of the case base 611. Further, the hole parts 713 and 714 of the ink output member 702 of the ink bag 600 are configured such that the hole parts 713 and 714 fit in gaps between inner surfaces of the ribs 718 and outer surfaces of the pin members 715 and 716.

Accordingly, the hole parts 713 and 714 of the ink output member 702 fit in gaps between the inner surfaces of the ribs 718 and the outer surfaces of the pin members 715 and 716 when the ink bag 600 is attached to the case base 611. Hence, it may be possible to attach the ink bag 600 to the case base 611 more securely.

Note that the relationship between the above holes (or hole parts) and the pin members may be applied to a case where the pin members are formed on the ink bag 600 side and the hole parts are formed on the case base 611 side.

Figure 25:
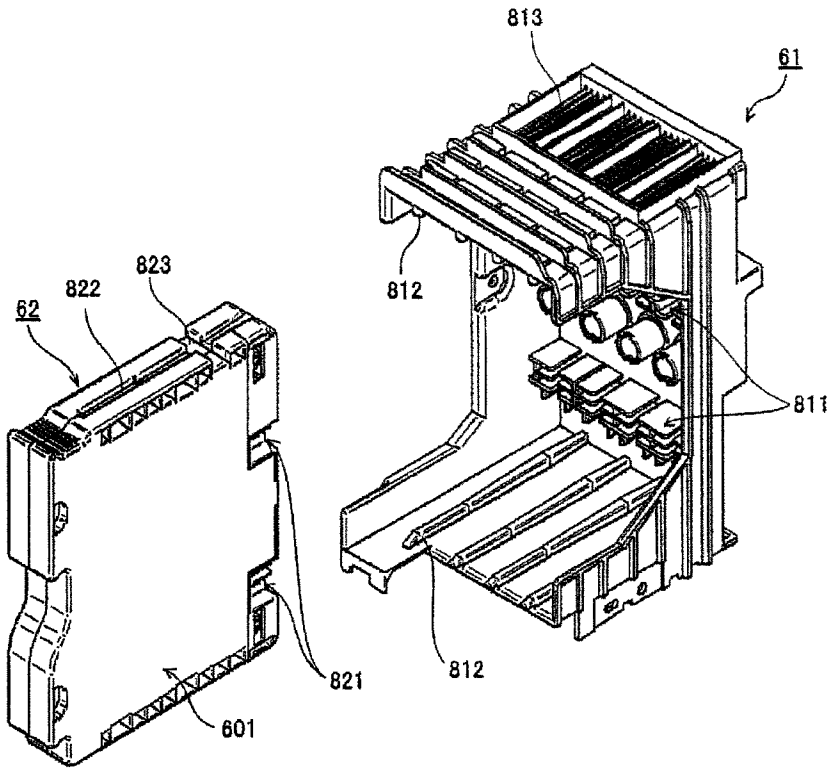
FIG. 25 is a perspective view depicting a state before the ink cartridge is attached to a cartridge holder for illustrating an ink cartridge attaching structure.
Figure 26:
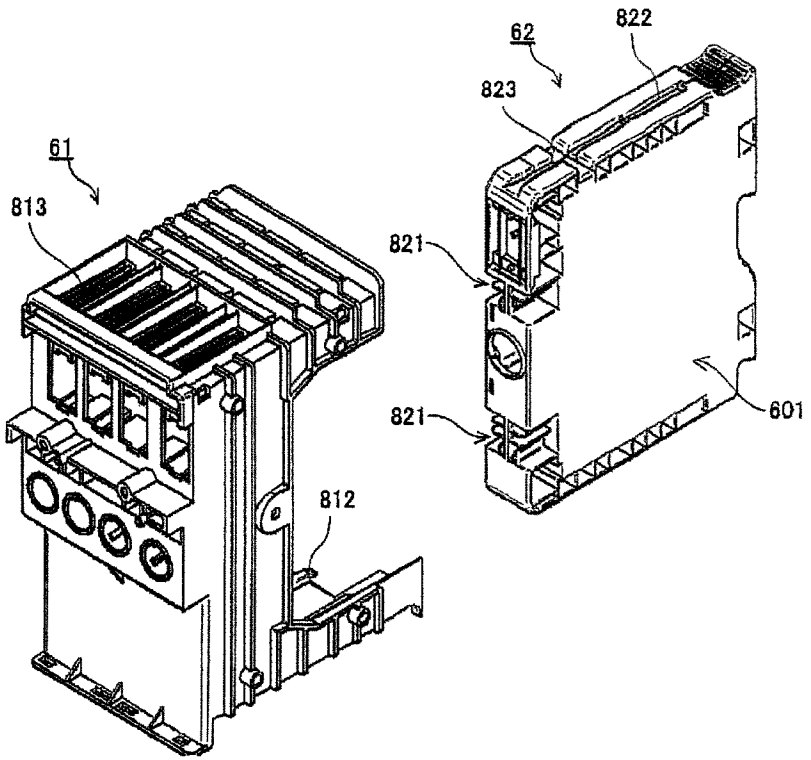
FIG. 26 is a perspective view illustrating a state before the ink cartridge is attached to the cartridge holder viewing from a side opposite from the state of FIG. 25.
Figure 27A:
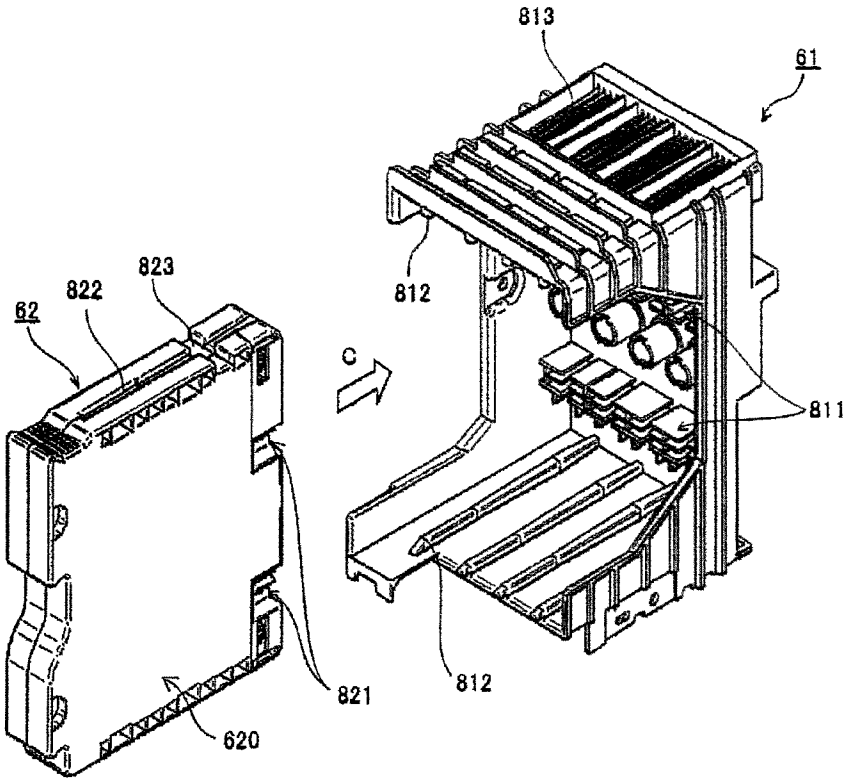
FIGS. 27A and 27B are perspective views illustrating respective states before and after the ink cartridge is attached to the cartridge holder.
Figure 27B:
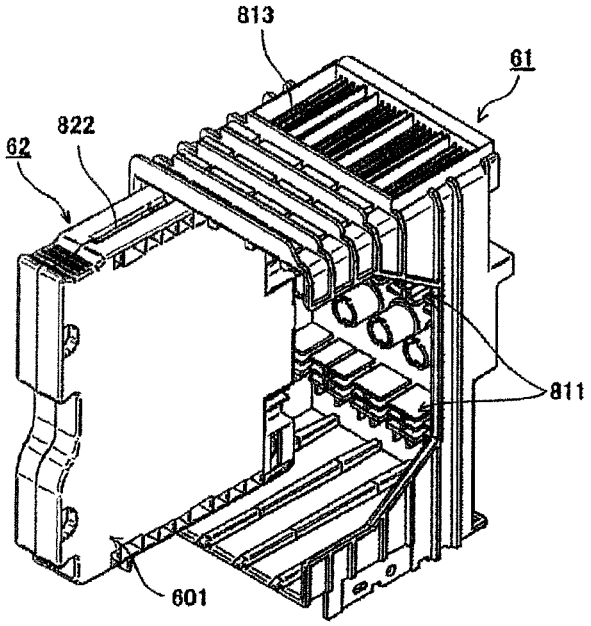
Figure 28:
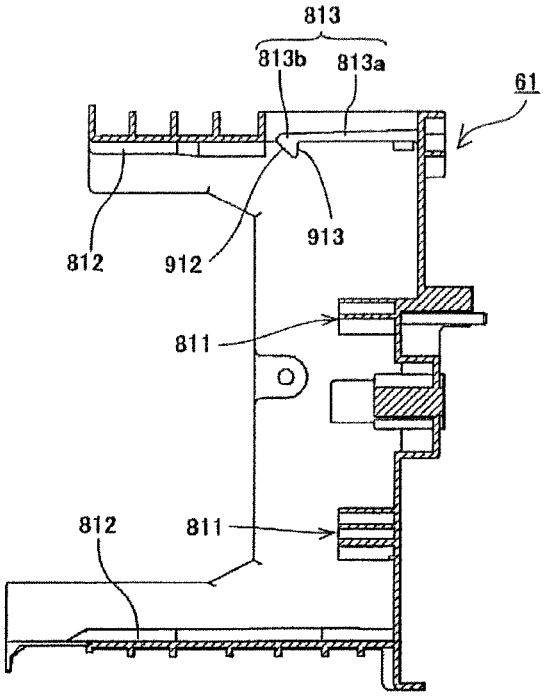
FIG. 28 is a side-sectional view illustrating the cartridge holder.
Figure 29:
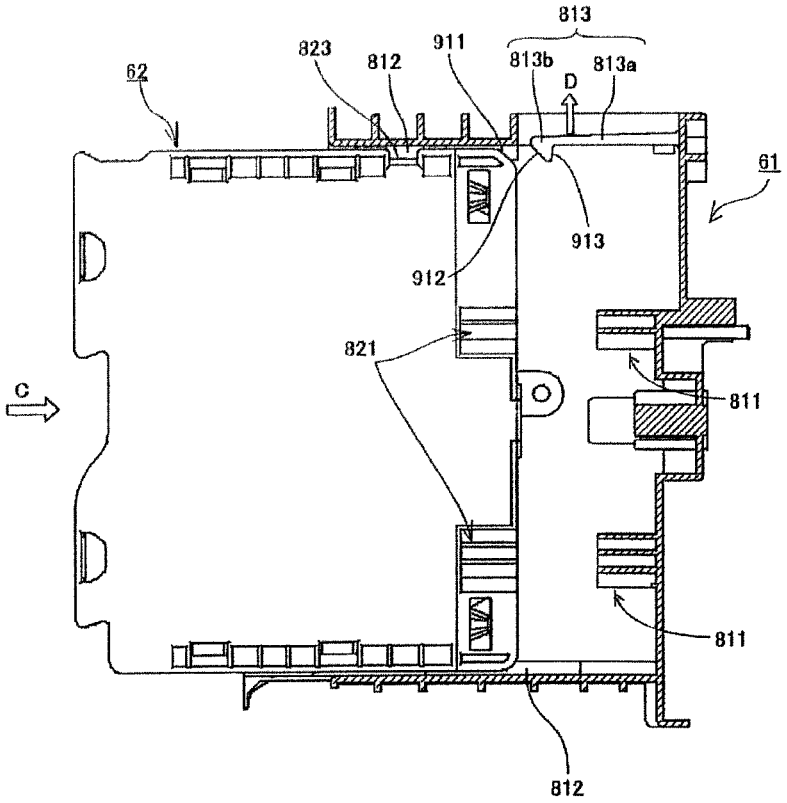
FIG. 29 is a side-sectional view illustrating a process of attaching the ink cartridge to the cartridge holder.
Figure 30:
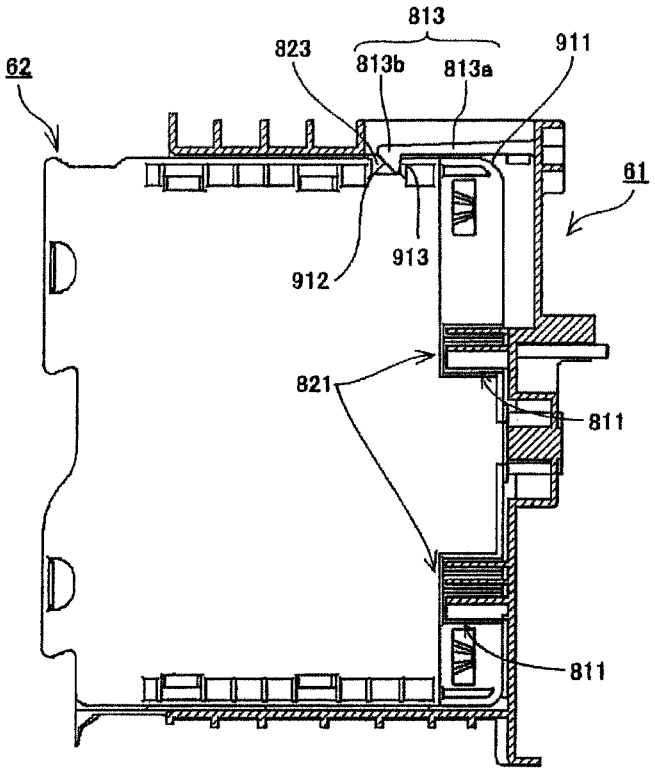
FIG. 30 is a side-sectional view illustrating a state in which the ink cartridge is attached to the cartridge holder.

Next, details of an attaching structure of the ink cartridge 62 in the image forming apparatus according to the embodiment are described with reference to FIGS. 25 to 30. FIG. 25 is a perspective view depicting a state before the ink cartridge 62 is attached to the cartridge holder 61 for illustrating an ink cartridge 62 attaching structure, FIG. 26 is a perspective view illustrating a state before the ink cartridge 62 is attached to the cartridge holder 61 viewing from a side opposite from the state of FIG. 25, FIGS. 27A and 27B are perspective views illustrating respective states before and after the ink cartridge 62 is attached to the cartridge holder 61, FIG. 28 is a side-sectional view illustrating the cartridge holder 61, FIG. 29 is a side-sectional view illustrating a process of attaching the ink cartridge 62 to the cartridge holder 61, and FIG. 30 is a side-sectional view illustrating a state in which the ink cartridge 62 is attached to the cartridge holder.

The ink cartridge 62 includes the ink cartridge case 601 that has the ink bag 600 containing a desired color of ink. The outer wall or the outer surface) of the cartridge case 601 includes identifier ribs 821 for identifying different types (i.e., color of containing liquid, size and model of the cartridge, hereinafter simply referred to as "color and the like") of the ink cartridge 62, guide grooves 822 utilized for attaching the ink cartridge 62 to the cartridge holder 61, and a hook recess 823 for being hooked by the cartridge holder 61.

The identifier ribs 821 are formed in a surface that faces a rear surface of the cartridge holder 61 when the cartridge case 601 is attached to the cartridge holder 61. The surface that faces the rear surface of the cartridge holder 61 is called a "rear surface" of the cartridge case 601. The guide grooves 822 are formed in surfaces that face a bottom side and a top side of the cartridge holder 61 when the cartridge case 601 is attached to the cartridge holder 61. The surfaces that face the bottom side and the top side of the cartridge holder 61 are called a "bottom surface" and a "top surface" of the cartridge case 601, respectively. The hook recess 823 is formed in the top surface of the cartridge case 601.

Meanwhile, the cartridge holder 61 includes identifier ribs 811 into which the identifier ribs 821 of the ink cartridge 62 are fit, guide ribs 812 configured to be fit into the guide grooves 822 of the ink cartridge 62, and hook parts 813 configured to hook on the hook recesses 823 of the corresponding ink cartridges 62.

A combination of the identifier rib 821 of the ink cartridge 62 and the identifier rib 811 of the cartridge holder 61 has a different fitting configuration corresponding to a different color and the like. Accordingly, the identifier rib 821 of the ink cartridge 62 for a predetermined color is fit into the appropriately identifier rib 811 of the cartridge holder 61, when the ink cartridge 62 for the predetermined color and the like is attached to the corresponding cartridge holder 61.

The guide grooves 822 of the ink cartridge 62 and the guide ribs 812 of the cartridge holder 61 are formed along a direction in which the ink cartridge 62 is attached to or detached from the cartridge holder 61.

The hook parts 813 of the cartridge holder 61 are integrally formed on the cartridge holder 61. The hook part 813 includes an elastic deforming part 813*a* configured to be elastically deformable and a claw part 813*b* configured to hook on the hook recess 823. The elastic deforming part 813*a* has a first end (hereinafter called a "rear-end part") uniformly formed on an inner surface of the cartridge holder 61, and a second end (hereinafter called a "front-end part") on which the claw part 813*b* is uniformly formed.

Further, the claw part 813*b* of the hook part 813 of the cartridge holder 61 has a sloped surface 912 that faces a front-end side of the cartridge case 601 when the ink cartridge 62 is attached to the cartridge holder 61 via the claw part 813*b* of the hook part 813 of the cartridge holder 61. Likewise, the cartridge case 601 of the ink cartridge 62 includes a sloped surface 911 that faces the sloped surface 912 of the claw part 813*b* of the hook part 813.

Further, the claw part 813*b* of the hook part 813 of the cartridge holder 61 has a sloped surface 913 on the side opposite to the sloped surface 912 in a direction in which the ink cartridge 62 is attached to or detached from the cartridge holder 61 (i.e., the inserting or extracting direction).

Thus, when the ink cartridge 62 is extracted from the cartridge holder 61, the hook part 813 of the cartridge holder 61 is lifted up by pulling the ink cartridge 62. Hence, the ink cartridge 62 is extracted from the cartridge holder 61. Similarly, when the ink cartridge 62 is inserted into the cartridge holder 61, the claw part 813*b* of the hook part 813 of the cartridge holder 61 is securely hooked on the hook recess 823 of the ink cartridge 62 (i.e., the cartridge case 601). Accordingly, the ink cartridge 62 is tightly attached to the cartridge holder 61.

Next, effects of attaching the ink cartridge 62 to or detaching the ink cartridge 62 from the cartridge holder 61 are described.

First, the ink cartridge 62 is inserted from an opening side of the cartridge holder 61 in a direction indicated by an arrow C illustrated in FIGS. 27A and 29. In this case, the guide grooves 822 of the ink cartridge 62 are initially fit into the respective guide ribs 812 of the cartridge holder 61. Hence, the ink cartridge 62 is guided by the guide ribs 812 while the ink cartridge 62 is inserted into the cartridge holder 61.

As described above, when the ink cartridge 62 is inserted into the cartridge holder 61, the guide ribs 812 and the guide grooves 822 are rubbing against each other to leave scratches on contact part a of the ink cartridge 62 side.

In the configuration according to the embodiment, since the ink cartridge 62 side includes the guide grooves 822 and the cartridge holder 61 side includes the guide ribs 812, the scratches remain only on an inner side the guide grooves 822 of the ink cartridge 62, which may scarcely be observable or viewable by a user.

Accordingly, since the scratches on the ink cartridges 62 due to the insertion or extraction of the ink cartridges 62 are not significantly observable, reusability of the ink cartridge 62 may be maintained.

Next, when the ink cartridge 62 is brought into contact with the hook part 813 integrally formed on the cartridge holder 61, the sloped surface 911 on the front side of the ink cartridge 62 side is in contact with the sloped surface 912 on the front side of the hook part 813 of the cartridge holder 61. In this configuration, the ink cartridge 62 is inserted into the cartridge holder 61 while the sloped surface 912 of the hook part 813 is in contact with the sloped surface 911 the ink cartridge 62, which elastically deforms the elastic deforming part 813*a* of the hook part 813 to lift up the claw part 813 in a direction indicated by an arrow D of FIG. 29 on the front side of the cartridge holder 61.

The hook part 813 vigorously pushes the ink cartridge 62 from the upper side in a direction in which the elastic deforming part 813*a* restores its original shape with its restoring force when the ink cartridge 62 is thrust into the cartridge holder 61 with the hook part 813 being lifted up. Accordingly, the orientation of the ink cartridge 62 may be stabilized while being thrust into the cartridge holder 61.

Note that the front side of the ink cartridge 62 and the front side of the claw part 813*b* of the hook part 813 have the respective sloped surfaces 911 and 912 in order to reduce setting force when inserting the ink cartridge 62 into the cartridge holder 61. However, the shapes of the front side of the ink cartridge 62 and the front side of the claw part 813*b* of the hook part 813 are not limited to the slopes in order to vigorously press the ink cartridge 62 by lifting up the hook part 813.

Further, when the ink cartridge 62 is inserted into the cartridge holder 61, the ink cartridge 62 reaches a position of the identifier rib 811 of the cartridge holder 61 configured to identify a type of the inserted ink cartridge 62. The identifier rib 811 includes plural ribs formed of a predetermined pattern and the identifier rib 821 having a predetermined pattern is formed on the ink cartridge 62 side corresponding to the predetermined pattern of the identifier rib 811 of the cartridge holder 61 such that the predetermined pattern of the identifier rib 811 appropriately fits in the predetermined pattern of the identifier rib 821.

The predetermined patterns of the identifier ribs 811 and 821 do not interfere with each other and appropriately fit into each other when a correct type of the ink cartridge 62 is inserted into the cartridge holder 61. However, the predetermined patterns of the identifier ribs 811 and 821 do interfere with each other and the insertion of the ink cartridge 62 is prevented when a wrong type of the ink cartridge 62 is inserted into the cartridge holder 61. Note that identifier units are formed of ribs in this embodiment; however, the identifier units are not limited to the ribs.

When an appropriate type of the ink cartridge 62 is inserted into the cartridge holder 61, a not-illustrated ink supply member such as a needle of the cartridge holder 61 side is inserted into the ink supply port 712 of the ink bag 600 in order to form a communication channel for ink contained inside the ink cartridge 62.

Finally, when the ink cartridge 62 is inserted at a predetermined position inside the cartridge holder 61, the previously lifted hook part 813 of the cartridge holder 61 is lowered and fit into the corresponding hook recess 823 of the ink cartridge 62. Accordingly, the ink cartridge 62 may be prevented from being detached from the cartridge holder 61.

Note that in this embodiment, functions of guiding the ink cartridge 62 with the guide ribs 812 and the guide grooves 822, thrusting the ink cartridge 62 with the hook part 813, identifying the type of the cartridge 62 with inconvertible ribs (i.e., the identifier ribs 811 and 812), inserting the ink supply member into the ink cartridge 62 inside the cartridge holder 61 side, and preventing the ink cartridge 62 from being detached from the cartridge holder 61 with the hook part 813 are performed in this order.

That is, it may be possible to insert and locate the ink output member 702 at an appropriate position of the ink cartridge 62 by causing the hook part 813 to vigorously thrust the ink cartridge 62 before the ink output member 702 of the cartridge holder 61 side is inserted into the ink cartridge 62.

Further, it may be possible to avoid erroneously inserting the ink output member 702 into a wrong type of the ink cartridge 62 to thereby mix different types of ink inside the ink output member 702 or the ink cartridge 62 by identifying the type of the ink cartridge 62 with inconvertible ribs before allowing the ink output member 702 to be inserted into the ink cartridge 62.

Note that in the present application, a material of the "sheet" is not limited to paper, but may include an overhead projector (OHP) film, cloth, glass, and a substrate, to which ink drops or other liquids are attachable. Examples of the materials for the sheets may be called a "recording medium subject to being recorded on", a "recording medium", "recording paper", and a "recording sheet". Further, the terms image forming, recording, printing, and copying may be used as synonyms.

Note also that the term an "image forming apparatus" indicates an apparatus that forms an image onto media such as paper, string, fiber, fabric, leather, metal, plastic, glass, wood, and ceramics by discharging liquid onto such media. Note also that the term "forming an image" or "image formation" not only indicates providing an image having some kind of meaning onto the media such as characters and symbols, but also indicates an image without having any meaning such as patterns (i.e., by simply discharging ink droplets onto the media).

Further, the term"ink" is not specifically limited to those generally called "ink", but may used as a generically called "liquid" capable of forming an image, such as a recording liquid, a fixing liquid, and a liquid. The term "ink" further includes DNA specimens, resist, a patterning material, resin, and the like.

Moreover, the "image" is not limited two-dimensional image, but may include an image applied to a three-dimensionally formed object, and to a three-dimensional image formed of a molded object.

According to the present embodiment, the workability of assembling of the liquid cartridge may be improved and the liquid cartridge may be automatically assembled.

All examples and conditional language recited herein are intended for pedagogical purposes to aid the reader in understanding the principles of the invention and the concepts contributed by the inventor to furthering the art, and are to be construed as being without limitation to such specifically recited examples and conditions, nor does the organization of such examples in the specification relate to a showing of the superiority or inferiority the invention. Although the embodiment of the present invention has been described in detail, it should be understood that various changes, substitutions, and alterations could be made hereto without departing from the spirit and scope of the invention.

This patent application is based on Japanese Priority Patent Application No. 2012-000416 filed on Jan. 5, 2012, the entire contents of which are hereby incorporated herein by reference.

What is claimed is:

1. A liquid cartridge containing a liquid to be supplied to a recording head to eject liquid drops, the liquid cartridge comprising:

a case member; and a liquid container member disposed inside the case member, wherein the case member includes a base member; and a cover member having a snap-fit part and configured to be fit in the base member, the cover member and the base member being snap-fit connected via the snap-fit part, and the base member includes an inserting hole part into which the snap-fit part is inserted in a snap-fit part inserting direction, and a viewing hole part provided separately from the inserting hole part, wherein the viewing hole provides a view, from a direction differing from the snap-fit part inserting direction, of a connection status of the snap-fit part of the cover member and the inserting hole part of the base member.

2. The liquid cartridge as claimed in claim 1, wherein the snap-fit part of the cover member is not projected from a surface of the case member.

3. The liquid cartridge as claimed in claim 1, wherein the snap-fit part of the cover member includes a shaft and blade parts on two sides of the shaft, the shaft and the blade parts forming an arrow shape in a direction of inserting the base member, and the blade parts are deformable with respect to the shaft.

4. The liquid cartridge as claimed in claim 3, wherein the shaft of the snap-fit part of the cover member includes a stem side and a top end side, the stem side being formed thicker than the top end side.

5. The liquid cartridge as claimed in claim 3 wherein ribs configured to regulate expansion of the blade parts of the snap-fit part so as not to exceed a predetermined amount of the expansion while the blade parts are being inserted into the snap-fit part.

6. An image forming apparatus comprising the liquid cartridge as claimed in claim 1.

* * * * *